United States Patent [19]

Schilling

[11] 4,353,401

[45] Oct. 12, 1982

[54] ROTATABLE SPLITTER

[75] Inventor: Walter W. Schilling, Delta, Canada

[73] Assignee: MacMillan Bloedel Limited, Vancouver, Canada

[21] Appl. No.: 199,188

[22] Filed: Oct. 21, 1980

[51] Int. Cl.[3] ..... B27L 7/00

[52] U.S. Cl. ..... 144/193 A; 144/193 E; 144/193 J; 254/104

[58] Field of Search ..... 144/193 R, 193 A, 193 K, 144/194, 3 K, 193 J; 254/104

[56] References Cited

U.S. PATENT DOCUMENTS 4,236,556 12/1980 Smith ..... 144/193 A

FOREIGN PATENT DOCUMENTS 2437917 6/1980 France ..... 144/193 A
142885 8/1980 Norway .

*Primary Examiner*—W. D. Bray

*Attorney, Agent, or Firm*—Schuyler, Banner, Birch, McKie & Beckett

[57] ABSTRACT

A method and apparatus for splitting a log substantially along the grain into a plurality of sector-shaped segments are described. The apparatus comprises at least one sector splitter ring having a plurality of blades, a support for locating the splitter ring in a log movement path, means for pushing the log axially along a log movement path, a rotating backplate for supporting one end of the log being pushed along, which backplate is adapted to tilt and allow the backplate-supported end of the log to rotate as the log is pushed through the splitter ring, and guide means adapted to retain the floating backplate in the log movement path. The process comprises forcing one end of a log axially against and through at least one splitting blade, the other end of said log being in contact with a backplate that can tilt, and permitting relative rotation between the log and the splitting blade so that a split occurring in the log from the splitting blade substantially tends to follow the grain in the log.

19 Claims, 9 Drawing Figures

ROTATABLE SPLITTER

This invention relates to splitting logs into segments. More particularly, this invention relates to a device and a method for splitting a log substantially along the grain of the wood.

There are two basic methods for splitting logs. The first method is impact splitting which is carried out with an axe or the like. The splitting occurs suddenly and completely due to the impact force of the axe head striking the end of a log. This method is generally only applicable to short logs; the axe or cutting head tends to stick in long logs. The second type of splitting is pressure splitting wherein a blade or wedge is pushed into one end of a log, or vice versa, such that a split or crack occurs in front of the blade and travels along the log as the blade continues to be pushed through the log. The present invention relates to pressure splitting and more specifically, splitting a log substantially along its grain.

In the past, logs have primarily been split for use as fire wood so that the quality of the split wood sections has not been important. In contrast, this invention comprises splitting logs substantially along the grain to maintain the grain integrity of the split sections. The present invention is concerned with the preparation of long wood strands for structural lumber products. An example of one type of structural lumber product fabricated from strands oriented along their length is disclosed in U.S. Pat. No. 4,061,819 issued Dec. 6, 1977.

One method for producing long wood strands with longitudinal grain extending along their length may involve radially splitting logs substantially along the grain into a plurality of sector-shaped segments. The segments are then processed further to produce long relatively thin strands, for example, by further splitting of the segments. Methods of producing wood strands by further splitting of wood segments are disclosed in copending U.S. patent application Ser. No. 199,191, entitled "Process for Preparation of Long Wood Strands", and copending U.S. patent application Ser. No. 199,190, entitled "3-Step Process for Preparation of Long Wood Strands", both filed concurrently herewith.

In the splitting of a log, the crack or split occurs in front of the blade. In many cases, the grain is not necessarily parallel to the axis of the log but follows a helical course and this causes the log to attempt to twist while being split. If the log cannot freely twist, the internal splitting forces become great and unwanted splits may occur. In some cases breaks may occur across the grain, thus resulting in slivers, splinters and undesirable short segments.

The types of logs which can be split into strands are conventional saw logs and pulp logs that have grain extended generally in line from end to end of the logs. Logs with interlocking spiral grain are, of course, difficult to split.

An object of the present invention is to provide a device and a method for splitting a log wherein the log is allowed to rotate so that the split tends to follow the grain in the wood.

Another object is to provide a splitting device having an end plate which can tilt to apply an even force to the end face of a log and which can rotate when the log is being split.

The present invention provides an apparatus for splitting a log substantially along the grain into a plurality of sector-shaped segments, comprising at least one sector splitter ring, having a plurality of blades, support for locating said splitter ring in a log movement path, pressure means for pushing the log axially along the log movement path, a rotating backplate for supporting one end of the log being pushed axially along the log movement path, said backplate adapted to tilt and allow the one end of the log to rotate while the log is pushed through the splitter ring, and guide means adapted to retain the floating backplate in the log movement path while the log is pushed through the splitter ring.

There is also provided in the present invention a method of pressure-splitting a log comprising the steps of: forcing one end of a log axially against and through at least one splitting blade, the other end of said log being in contact with a backplate which can tilt, and simultaneously permitting the log and the splitting blade to rotate relative to each other so that a split occurring in the log from the splitting blade substantially tends to follow the grain in the log.

This invention permits the unsplit portion of the log to rotate freely as it approaches the splitting blades during the splitting operation. In addition, the backplate tilts to press evenly upon the back of the log thereby maintaining a centered forward thrust on the log. By use of the backplate according to this invention, the power requirements of the splitter and internal machine forces are reduced.

In drawings which illustrate embodiments of the invention,

Figures 1, 7, 8:
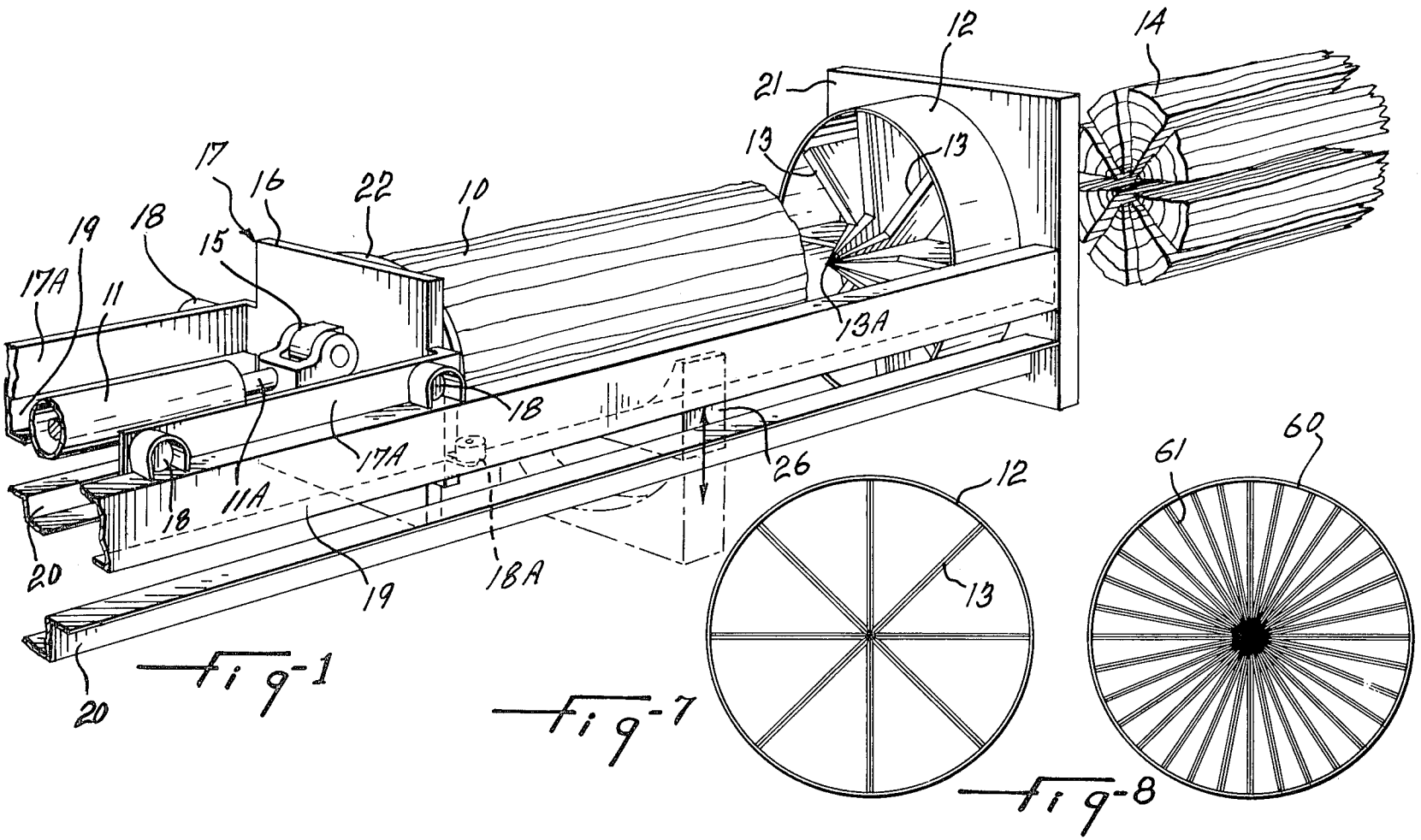
FIG. 1 is an isometric view of a log passing through one embodiment of a sector splitter according to the present invention.

FIG. 7 shown on the first page of drawings, is an elevation of an eight sector splitter ring.

FIG. 8 shown on the first page of drawings, is an elevation of a thirty-two sector splitter ring.

Figures 2, 3, 4, 9:
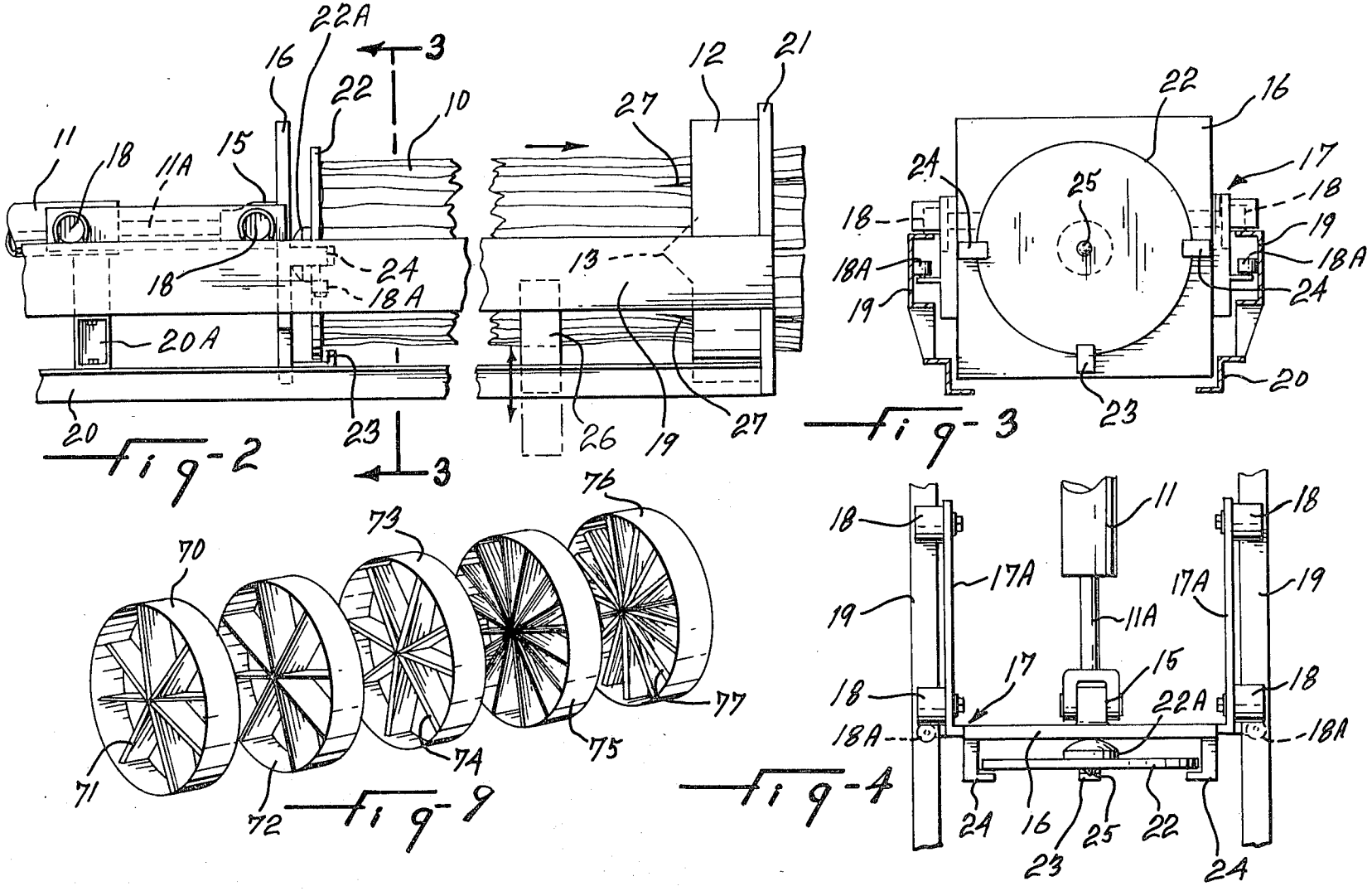
FIG. 2 is a side elevation of a log positioned in the sector splitter of FIG. 1.
FIG. 3 is a cross section through the sector splitter of FIG. 2 taken at line 3—3 showing the rotating backplate.
FIG. 4 is a partial plan view of the sector splitter of FIG. 2 showing the rotating backplate.

FIG. 9 is an exploded isometric view showing an assembly of three sector splitter rings.

Logs suitable for splitting are generally straight and meet normal requirements for conventional saw logs or pulp logs. Knots in a log generally pass through a sector splitter without causing problems.

The moisture content of the logs is preferably maintained at not less than fiber saturation during splitting. Fiber saturation represents approximately 30% moisture content, varying slightly from one type of wood to another. High moisture content does not present a problem in pressure splitting but dry logs tend to resist pressure splitting and more force is needed to push dry logs through a splitter.

In some cases it is preferable to debark the logs before the splitting step. The decision to debark depends on the type of wood being split and the use to which the resulting product is to be put. The debarking step has no bearing on the splitting step which can be carried out on barked or debarked logs.

Referring now to FIGS. 1 and 2, a log 10 is shown being pushed by a hydraulic cylinder 11 through a sector splitter ring 12. The sector splitter ring 12 has splitting blades 13 arranged to split the log 10 into eight sector shaped segments 14. The arrangement of blades shows the center of each blade extending forwards to form a central tip 13A. This configuration aids in the commencement of splitting a log, but is not essential. The hydraulic cylinder 11 has a link connection 15 at the end of the piston rod 11A joined to the support plate 16. The support plate 16 forms the forward plate of a carriage 17 having arms 17A extending back on each side with two support rollers 18 resting on the flanges of side channels 19 which form part of the frame 20 for the splitter. Side rollers 18A attached to the sides of the support plate 16 guide the carriage 17 and run on the inside web of the side channels 19. Thus, the hydraulic cylinder 11 moves the carriage 17 horizontally forwards and backwards in a log movement path. The hydraulic cylinder 11 is attached to a support bracket 20A which in turn is rigidly attached to the side channels 19 and the frame 20. Similarly, the splitter ring 12 is mounted on a backing plate 21 rigidly attached to the side channels 19 and the frame 20. The carriage assembly 17, shown more clearly in FIGS. 3 and 4, has a rotating backplate 22 which is held to the support plate 16 by means of a base clip 23 and two side clips 24. The backplate 22 has a button or disc 22A attached to the back thereof. The button 22A has a domed back surface to aid in allowing the backplate to tilt thus enabling the backplate to press evenly over the end surface of the log which may not be square with the log axis. The backplate 22 is a circular disc and is held in the three clips 23 and 24 merely by its own weight. The lower clip 23 provides limited space for the backplate 22 to tilt. Similarly the two side clips 24 also allow the backplate 22 to tilt in either direction. The distance between the two side clips 24 is sufficiently larger than the diameter of the backplate 22 to allow limited sideways movement of the backplate 22. Thus, the backplate 22 may rotate on the button 22A within the clips 23 and 24, it may tilt about the button 22A within the clips 23 and 24 and has a sideways movement which is limited by the location of the two side clips 24. This movement is preferably limited to between one quarter and one half inch. In a preferred embodiment a pin 25 is provided at the center of the front face of the rotating backplate 22. The pin 25 is used to engage the log prior to splitting.

Figure 5:
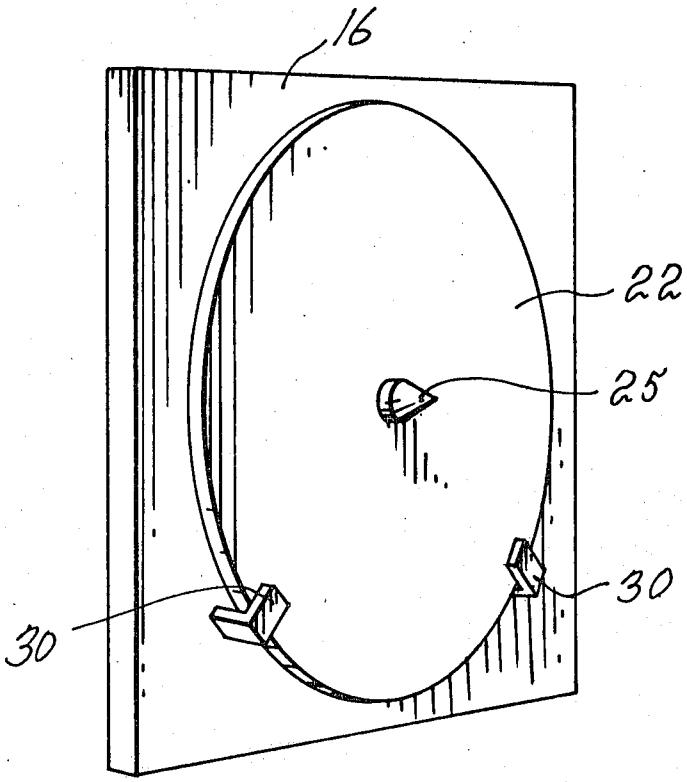
FIG. 5 is an isometric view of another embodiment of a rotating backplate.

Another embodiment of an arrangement between the support plate 16 and the backplate 22 is shown in FIG. 5 wherein only two side clips 30 are provided to hold the backplate 22 in position. The side clips 30 allow the backplate 22 to rotate and tilt. They also allow the backplate to be raised and, if necessary, removed from the carriage 17.

When a long log is to be split, at least one axial support 26 as shown in FIGS. 1 and 2 is preferably used to support the log 10 for the first portion of the push through the splitter ring 12. Although only one axial support 26 is shown, several may be used and they should be removed as the log 10 is slowly pushed through the splitter ring 12.

A log 10 preferably is positioned such that one end has its growth center at the central tip 13A of the blades 13 in the splitter ring 12. Axial supports 26 may be placed under the log 10 resting on the frame 20. The hydraulic cylinder 11 pushes the carriage assembly 17 along the log movement path. Pin 25 on the rotating backplate 22 is optional because the pressure between the backplate and log is generally great enough to support the log. If the end of the log is not perpendicular, the backplate 22 tilts about the button 22A to ensure that the pressure is spread evenly over the end of the log. The hydraulic cylinder 11 then proceeds to push the log 10 through the splitter ring 12 to produce segments 14. As the blades 13 of the splitter ring 12 enter the end of the log 10, a split or crack 27 as shown in FIG. 2 commences at each blade and extends backwards along the log for a considerable distance. The split may extend backwards for any length up to the complete length of the log. This causes the segments 14 to spread outwards, so the apparent diameter of the arrangement of segments 14 leaving the splitter ring 12 is considerably larger than the diameter of the log 10. As the log is pushed by the hydraulic cylinder 11 the grain in each log does not follow a straight line, but may twist in the log. The rotating backplate 22 with the button 22A at the back thereof allows the other end of log 10 to follow this twisting movement so that the split 27 follows and extends along the grain rather than being forced across the grain. If a long log 10 is being split, the axial supports 26 should be removed as the carriage 17 moves along the side channels 19.

In practice it has been found that permitting limited sideways movement of the backplate is not an essential feature of the present invention but only one embodiment. The configuration shown in FIGS. 3 and 4 allows limited sideways movement of the backplate, but the embodiment shown in FIG. 5 does not. Both embodiments provide a rotatable connection allowing the backplate to rotate as required by the grain in the log, and to pivot to conform to the end face of a log so that the hydraulic cylinder 11 applies a force evenly over the end face of the log.

When the rotating backplate 22 is within a short distance of the splitter ring 12, provision should be made to complete passage of the log through the splitter ring 12 without allowing the backplate 22 to press against the splitter ring 12, which may damage the splitter ring. The direction of travel of the hydraulic cylinder 10 is reversed and the carriage 17 is moved back. If another log is to be split, then after the carriage 17 is moved back to its starting position, a second log is positioned with one end resting against the end of the first log still in front of the splitter ring 12, and the other end of the second log is placed with its grain center on the centering pin 25 of the backplate 22. The hydraulic cylinder 11 is then activated so the second log pushes the end of the first log through the splitter ring 12. The second log is then split in the normal manner. Alternatively, if there are no more logs to be split, then a special device (not shown) is rigidly mounted on the support plate 16 of the carriage 17. The special device has fingers or probes that extend between the blades 13 of the sector ring 12. The hydraulic cylinder 11 is then activated so that the special device pushes the end of the log 10 completely through the splitter ring 12. Other devices such as one which grips the split ends of the log and pulls the log completely through the splitting ring may also be employed.

Figure 6:
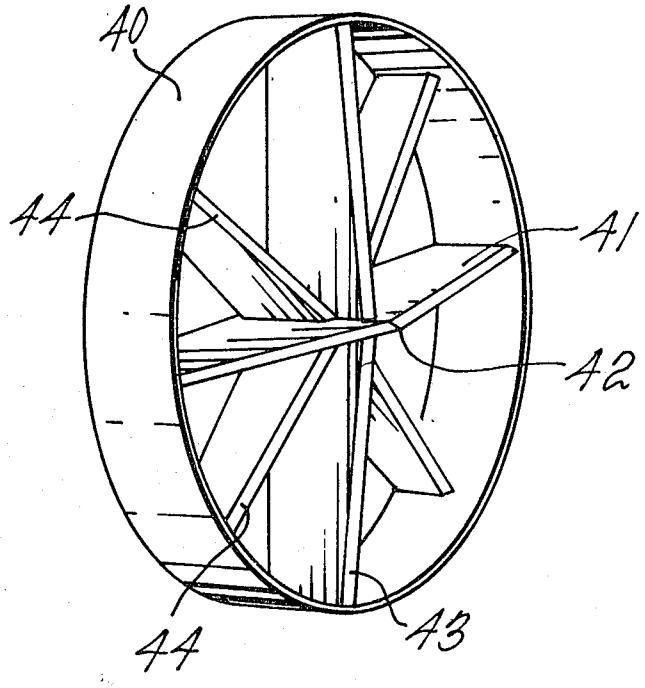
FIG. 6 is an isometric view of another embodiment of a sector splitter ring.

An alternate embodiment of the splitter ring is shown in FIG. 6 wherein a leading horizontal blade 41 extends across the face of the splitter ring 40 and has trailing edges from a center point 42. A vertical blade 43 extends across the splitter ring 40 behind the leading blade 41 and two sets of blades 44 between the horizontal blade 41 and the vertical blade 43 are set back from the vertical blade 43. This embodiment reduces the instant load at commencement of splitting because the horizontal split commences followed by the vertical split and the two angled splits.

The splitter ring 12 preferably has eight blades as shown in FIGS. 6 and 7, which split a log into eight substantially equal sector-shaped segments. However, in another embodiment a different splitter ring 60 as shown in FIG. 8 has thirty-two blades 61. The number of blades is dependent upon the number of segments required. It will be apparent to those skilled in the art that employing a single splitting blade extending across the diameter of the log would be the simplest splitting operation, requiring application of the smallest amount of force to effect the splitting. On the other hand, when more than thirty-two blades are used, considerable force must be applied to the end of the log and a certain amount of crushing or splintering of the wood may occur.

FIG. 9 shows another embodiment wherein three separate splitter rings and two spacers are combined. A first splitter ring 70 has blades 71 and is followed by a spacer ring 72 which also acts as a guide to ensure that the segments of wood retain their position and do not move either too far radially outward or twist out of their initial location. A second splitter ring 73 has blades 74 positioned so that they split the segments which have been first split in the first splitter ring 70. Following the second splitter ring 73 is a further spacer ring 75 which ensures that the split segments retain their position, and then finally a third splitter ring 76 with blades 77 to split the segments yet a further time. The three splitter rings 70, 73 and 76 produce narrow segments. In a preferred embodiment the first two splitter rings each have eight blades and the third splitter ring has sixteen blades, thus producing thirty-two wood segments. It will be understood that both the splitter rings and the spacer rings are mounted on the side channels 19. In other embodiments with fewer blades in the splitter rings, the spacer rings may be omitted.

It will be apparent to those skilled in the art that various changes may be made in the details of the splitter device shown in the drawings without departing from the scope of the present invention which is limited only by the claims. For instance, the end plate may be attached to and supported from the piston rod by, for example, a ball bearing and socket arrangement that allows the plate to rotate and tip. In addition, the hydraulic cylinder may operate from the opposite end of the apparatus and push the splitter ring through the log. The rotating backplate still allows the free end of the log to rotate. In another embodiment the splitter ring or the assembly of several splitter rings may be allowed to rotate to aid in splitting a log along the grain. The backplate in this embodiment may or may not rotate but is capable of tipping.

Whereas a hydraulic cylinder has been described herein as the only pressure means for pushing the log through the splitter ring assembly, other types of pressure means such as air cylinders or mechanical chain systems may also be employed.

I claim:

1. An apparatus for splitting a log substantially along the grain into a plurality of sector-shaped segments comprising:

at least one sector splitter ring having a plurality of blades, support for locating said splitter ring in a log movement path, pressure means for pushing the log axially along the log movement path, a rotating backplate for supporting one end of the log being pushed axially along the log movement path, said backplate adapted to tilt and allow the one end of the log to rotate while the log is pushed through the splitter ring, and guide means adapted to retain the floating backplate in the log movement path while the log is pushed through the splitter ring.

2. The apparatus according to claim 1 wherein the rotating backplate is circular and has a disc attached at the center thereof resting against a carriage support plate, the disc permitting the backplate to rotate and tilt relative to the carriage support plate, and wherein the pressure means is applied to the carriage support plate.

3. The apparatus according to claim 2 wherein the splitter ring has one blade positioned in advance of the other blades to commence splitting the log, and other blades positioned behind the one blade.

4. The apparatus according to claim 2 wherein the splitter ring blades extend forward at the junction thereof to form a central tip.

5. The apparatus according to claim 2 wherein the splitter ring is an eight segment sector splitter ring adapted to split the log into eight substantially equal sector shaped segments.

6. The apparatus according to claim 2 wherein the rotating backplate has a central pin.

7. The apparatus according to claim 2 wherein the pressure means comprises a hydraulic cylinder pushing against the carriage support plate.

8. The apparatus according to claim 2 wherein the rotating backplate is loosely supported on the carriage support plate by two side clips and one lower clip permitting the backplate to have limited sideways movement.

9. The apparatus according to claim 1 having three sector splitter rings with spacer guides between the splitter rings, adapted to divide the log into thirty-two segments.

10. The apparatus according to claim 1 including axial support means for supporting the log while being pushed axially along the log movement path.

11. The apparatus according to claim 1 which contains means to permit the sector splitter ring to rotate relative to the support.

12. An apparatus for splitting a log substantially along the grain into a plurality of sector-shaped segments comprising:

at least one sector splitter ring having a plurality of blades, support means for locating said splitter ring in a log movement path, said splitter ring adapted to rotate relative to the log while being pushed therethrough, pressure means for pushing the splitter ring axially into one end of the log and along the log, a backplate and a backplate support for supporting the other end of the log, said backplate adapted to tilt, and guide means adapted to retain the log in position while the splitter ring is pushed through the log.

13. The apparatus according to claim 12 which includes means to permit the backplate to rotate relative to said backplate support.

14. A method of pressure-splitting a log comprising the steps of: forcing one end of a log axially against and through at least one splitting blade, the other end of said log being in contact with a backplate which can tilt, and simultaneously permitting the log and the splitting blade to rotate relative to each other so that a split occurring in the log from the splitting blade substantially tends to follow the grain in the log.

15. The method according to claim 14 wherein the other end of the log is permitted to rotate.

16. The method according to claim 15 wherein the other end of the log is permitted to have limited sideways movement simultaneously to rotating.

17. The method according to claim 14 wherein the log is split into a plurality of segments and wherein the one end of the log is forced through at least one splitter ring containing a plurality of splitting blades.

18. The method according to claim 17 wherein the log is split into eight segments.

19. The method according to claim 17 wherein the log has a moisture content of at least fiber saturation.

* * * * *